US009217567B2

(12) United States Patent
Martin

(10) Patent No.: US 9,217,567 B2
(45) Date of Patent: Dec. 22, 2015

(54) ADJUSTABLE AND ROBUST RADIANT WALL BURNER TIP

(71) Applicant: Honeywell International, Inc., Morristown, NJ (US)

(72) Inventor: Matthew Martin, Tulsa, OK (US)

(73) Assignee: Honeywell International, Inc., Morris Plains, NJ (US)

( * ) Notice: Subject to any disclaimer, the term of this patent is extended or adjusted under 35 U.S.C. 154(b) by 438 days.

(21) Appl. No.: 13/833,270

(22) Filed: Mar. 15, 2013

(65) Prior Publication Data

US 2015/0044618 A1 Feb. 12, 2015

(51) Int. Cl.
*F23D 14/02* (2006.01)
*F23D 14/12* (2006.01)
*F23D 14/70* (2006.01)

(52) U.S. Cl.
CPC ..... *F23D 14/02* (2013.01); *F23D 14/125* (2013.01); *F23D 14/70* (2013.01)

(58) Field of Classification Search
CPC ..... F23D 14/02; F23D 14/06; F23D 14/70; F23D 14/125; F23D 14/62
See application file for complete search history.

(56) References Cited

U.S. PATENT DOCUMENTS 2,063,396 A * 12/1936 Parrigin ..... 239/434.5
5,271,729 A * 12/1993 Gensler ..... F23C 6/047 431/175
2014/0102440 A1* 4/2014 Martin ..... F23C 6/047 126/91 R

OTHER PUBLICATIONS

Low NOx Burner Maintenance in High Temperature Furnaces; McAdams, Jason, Karan, Jay, Witte, Roger, and Claxton, Mike. AIChE Conference; 2002.

* cited by examiner

*Primary Examiner* — Alfred Basichas

(57) ABSTRACT

A radiant wall burner apparatus. The apparatus includes an orifice for the introduction of fuel gas into an elongated mixing conduit for the directional flow and mixing of the fuel gas with combustion air provided through an inlet. The fuel gas and air mixture terminates through an adjustable burner tip. The radiant wall burner apparatus and burner tip allow for a two-leaf, adjustable radiant wall burner tip design that is less susceptible to heat deformation, flashback, and self-destruction, having fewer manufacturing issues, and having the capability to use hydrogen as a fuel source.

7 Claims, 3 Drawing Sheets

ADJUSTABLE AND ROBUST RADIANT WALL BURNER TIP

FIELD OF THE INVENTION

The invention relates generally to an apparatus for a radiant wall burner. More particularly, the invention relates to an improved, adjustable and robust radiant wall burner tip.

DESCRIPTION OF THE RELATED ART

Radiant wall burners can be used as a "premix" burner or as a raw gas burner. For use as a premix burner, the burner system typically includes the use of an elongated pipe or tube used for mixing combustion air and fuel gas to achieve a stable, efficient combustion. The mixing tube is inserted into a furnace wall and connects to a burner tip on the other side of the furnace wall. Fuel can be introduced at different points of the burner. Fuel introduced first, or upstream in the burner, is commonly referred to as "primary fuel." A secondary fuel source can be introduced downstream in the burner and is commonly referred to as "staged fuel." The air required for combustion is drawn into the mixing tube and mixed with the primary fuel gas before the fuel and air mixture gets to the combustion zone of the burner. Thus, the elongated mixing tube transports the required combustion air and fuel gas mixture downstream and through the burner tip, where the combustion air and fuel gas mixture radially terminates on the other side of the furnace wall.

If the burner is not a premix burner, and instead is used to burn pure or raw fuel, the primary fuel is not mixed with the combustion air in the elongated tube, but is simply delivered as a pure fuel to the combustion zone.

To provide for stable and efficient radial distribution of the mixture or of the pure fuel, current radiant wall burner tips are either aerodynamically shaped as a multiple leaf turning vane or have a slotted design with an internal turning vane. Prior art designs have manufacturing issues, have limited capability for use of hydrogen as a fuel, and are susceptible to heat deformation, flashback, and self-destruction. Further, prior art designs are difficult or impossible to adjust in order to provide for the desired burning capacity.

Prior art designs featuring a turning vane of multiple leaves are exposed to a variety of manufacturing issues. The greater number of leaves and pieces in construction naturally leads to more difficulty in manufacturing. Each component piece, or leaf, has to be cast or otherwise fabricated. The area of the burner tip opening or openings is precisely measured in order to provide for the desired burning capacity. Improper casting can lead to a deformed or defunct burner tip that impairs the desired burning capacity. Further, for stability, every piece in the burner tip must be supported or connected to another piece so that the leaves do not simply burn off under high heat stress. Methods for support or connection could ultimately impair the flow extruding from the burner tip, leading to a non-uniform flow. Commonly, vertical pins are used between each leaf for support and to connect each leaf to each other. However, the vertical pins create a flow back and ultimately result in an uneven, non-uniform flow of the fuel or fuel and air mixture. There is a need for an adjustable radiant wall burner tip which is simple to manufacture, having less components than the prior art, and therefore reducing the opportunity of manufacturing issues.

Radiant wall burners used in furnaces provide for a high heat release in a small area with internal furnace temperatures ranging from 2100-2300° F. Such high heat release may lead to deformation of the burner tip affecting burner performance.

In prior art designs, leaves tend to deform under heat stress causing the leaf to bend and eventually fall off onto the furnace floor.

Further, current designs are also prone to having regions of the flow that make them susceptible to flashback and subsequent self-destruction. With such high heat release in a radiant wall burner, flashback is a likely problem. Flashback is the sudden combustion of either the mixture of fuel and combustion air inside the radiant wall burner tip. It occurs when the flame propagation velocity exceeds the discharge velocity of the air and primary fuel gas mixture exiting the tip. The differences in velocities can cause the flame to propagate back inside the tip and ignite the mixture inside the burner tip. Such flashback may cause thermal damage to the burner tip leading to warping or drooping, and even sometimes falling off onto the furnace floor. Therefore, there is a need for an improved radiant wall burner tip with a design that provides for a discharge velocity that exceeds the flame propagation velocity of the fuel and combustion air mixture.

Further, combustion of fuels with high hydrogen content may provide for a greater opportunity of flashback. The flame speed during combustion of a high hydrogen content fuel is much greater than the flame speed of the combustion of other fuels such as natural gas. Therefore, when using pure hydrogen as a fuel, the radiant wall burner needs to provide for a discharge velocity which always exceeds the flame propagation velocity of the high hydrogen content fuel.

Further, current designs can be hard or impossible to adjust, and even when they feature an adjustment method, the method is highly susceptible to heat deformation. Burner tips may need to be adjusted in order to accommodate the desired burning capacity, allowing more or less flow of the combustion air and primary fuel gas mixture as required by the amount of desired combustion. Additionally, any part of the burner tip may be subject to thermal stress and so the component used to adjust the burner tip may result in damage from such high heat as required by radiant wall burners. Therefore, there is a need for an improved radiant wall burner tip which includes a simple and efficient method of adjusting the burner tip, where the adjustment component is kept in a cool area away from possible heat damage.

Accordingly, it is an object and purpose of the invention to provide an improved, adjustable radiant wall burner tip that is simple to manufacture, having few component pieces thereby reducing the opportunity for manufacturing issues.

It is a further object and purpose of the invention to provide an improved, adjustable and robust radiant wall burner tip that provides heat conduction pathways to cool the burner tip.

It is a further object and purpose of the invention to provide an improved, adjustable and robust radiant wall burner tip with an aerodynamic design to remove dead flow and recirculation zones thereby reducing the potential of flashback.

It is a further object and purpose of the invention to provide an improved, adjustable and robust radiant wall burner tip with an aerodynamic design with an exit area that allows for acceleration of flow as it exits the tip, thereby reducing the potential of flashback.

It is a further object and purpose of the invention to provide an improved, adjustable and robust radiant wall burner tip that has a simple and precise method for adjusting the exit gap width, while maintaining the desired burning capacity and efficiency regardless of the adjustment setting.

It is a further object and purpose of the invention to provide an improved, adjustable and robust radiant wall burner tip with a burner tip gap adjustment existing in the cool zone of the burner, thereby reducing the exposure to heat damage.

SUMMARY OF THE INVENTION

The invention is directed to an improved, adjustable and robust radiant wall burner apparatus for use in furnaces.

An elongated mixing conduit having an inlet end and an outlet end is inserted into a wall of a furnace. Combustion air and primary fuel gas, such as hydrogen, are introduced at the inlet end of the mixing conduit. Combustion air and primary fuel gas combine inside the mixing conduit. A burner tip is located at the outlet end, adjacent to the mixing conduit. The combustion air and primary fuel gas mixture moves downstream in the mixing conduit, from the inlet end to the outlet end, and radially terminates on the other side of the furnace wall through the exit gap of the burner tip.

An orifice runs parallel with the mixing conduit, creating an axis through the mixing conduit and the burner tip. The orifice supplies the primary fuel gas at the inlet end. Further, the orifice may provide secondary fuel gas at the outlet end.

In the example, the burner tip includes an exit gap defined by two discoidal leaves. Depending on the desired burning capacity, the exit gap may be adjusted by an adjustment mechanism, such as an adjustor pipe located in the cool zone of the burner tip, between the two discoidal leaves. The primary fuel gas and air mixture distributes radially through the adjustable exit gap of two-piece burner tip. Regardless of the leaf adjustment setting, the exit gap will maintain minimum area with a high discharge velocity.

The burner tip design provides for a robust and aerodynamic design which allows for conduction pathways that will cool the burner tip, reducing heat deformation of the tip. The improved, aerodynamic design includes a knife-like or sharp edge around the upper leaf which serves to eliminate attachment of the flame, thereby removing the dead flow zones and reducing recirculation of the flame back into the tip. The lower leaf extends beyond the upper leaf with a downward lip which will enhance acceleration of the flame through the exit gap. Reducing recirculation and dead flow zones, while providing for enhanced acceleration at the exit gap, will ultimately reduce the occurrence of flashback and subsequent self-destruction of the burner tip. Further, with the improved design that reduces the potential of flashback, the burner tip has the capacity to use pure hydrogen as a fuel source.

DETAILED DESCRIPTION OF THE INVENTION

The invention discussed herein is merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figure 1:
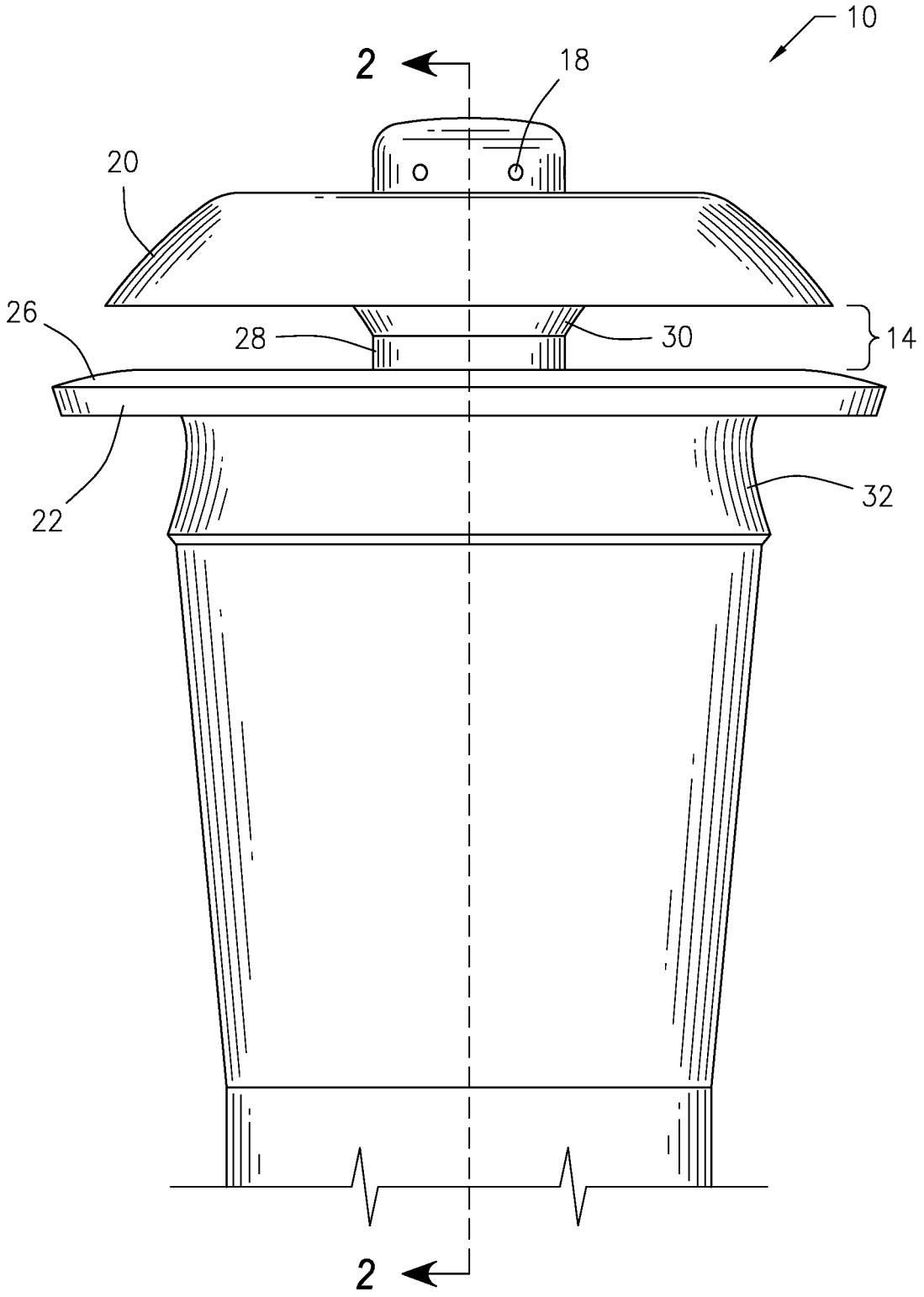
FIG. 1 illustrates a front view of an example of a radiant wall burner tip constructed in accordance with the invention.

Referring to the drawings in detail, FIG. 1 illustrates a front view of an example of a radiant wall burner tip 10 constructed in accordance with an illustrative embodiment of the invention.

In a premix gas radiant wall burner, combustion air and the primary fuel gas mix in an elongated mixing conduit which provides a flow area for the mixture. A burner tip 10 is located at the outlet end of the mixing conduit. The air and primary fuel gas mixture flows downstream, from the inlet end to the outlet end of the mixing conduit and terminates through an exit gap 14 of the burner tip. As the air and primary fuel gas mixture approaches the burner tip, the air and primary fuel gas mixture is directed so that it flows radially outward through the exit gap 14.

An orifice (not shown) may run parallel to and through the mixing conduit. The orifice serves as a source for the primary fuel gas at the inlet end. The orifice may extend beyond the burner tip and supply secondary fuel gas through ports 18.

The burner tip consists of two separate elements or pieces, an upper leaf 20 and a lower leaf 22. Both leaves may be composed of a thick metal. Both the upper leaf 20 and the lower leaf 22 may have a discoidal shape. The upper leaf creates a concave shell having an outer circumference that extends radially downward with a sharp or knife-like edge creating a slight restriction. In the event that the flame tries to recirculate, the sharp or knife-like edge discourages the flame from attaching to the burner tip thereby reducing the amount of heat exposure and damage to the upper leaf 20. The internal concave shape of the upper leaf 20 ensures that the area of the exit gap 14 is always the minimum area and therefore the highest velocity point, regardless of the leaf adjustment. The upper leaf 20 has an inner circumference that extends downwardly creating a cylindrical orifice cavity 30. The orifice cavity 30 extends so far as to line up with an adjustment pipe 28 that is precisely cut to provide a desired width for the exit gap 14.

The lower leaf 22 may also have a discoidal shape. The lower leaf 22 may be positioned directly adjacent to the mixing conduit. The lower leaf 22 has an outer circumference that extends radially downward beyond the upper leaf creating a curved lip 26. The curved lip design allows for streamline acceleration, preventing low velocity at the exit gap 14. The size of the exit gap 14, i.e. the distance between the upper leaf 20 and the lower leaf 22, may be adjusted by an adjustment mechanism, such as an adjustment pipe 28 located along the wall of an orifice cavity 30. The lower leaf 22 has an inner circumference that creates a neck 32 and mounts onto the mixing conduit. The lower leaf 22 may have internal webbing pins (shown in FIGS. 2 & 3) used for support. The primary fuel and the combustion air mixture flows downstream through the mixing conduit, from the inlet end to the outlet end and through the burner tip exit gap. The mixture exits through the burner tip exit gap 14 which provides a reduced flow area in order to increase the exit velocity.

An orifice may extend through the lower leaf 22 and the upper leaf 20 supplying secondary fuel gas through ports 18 outside of the burner tip 10. The upper leaf 20 may have an outer coating in order to help induce combustion air and promote combustion with the secondary fuel gas from ports 18.

Figure 2:
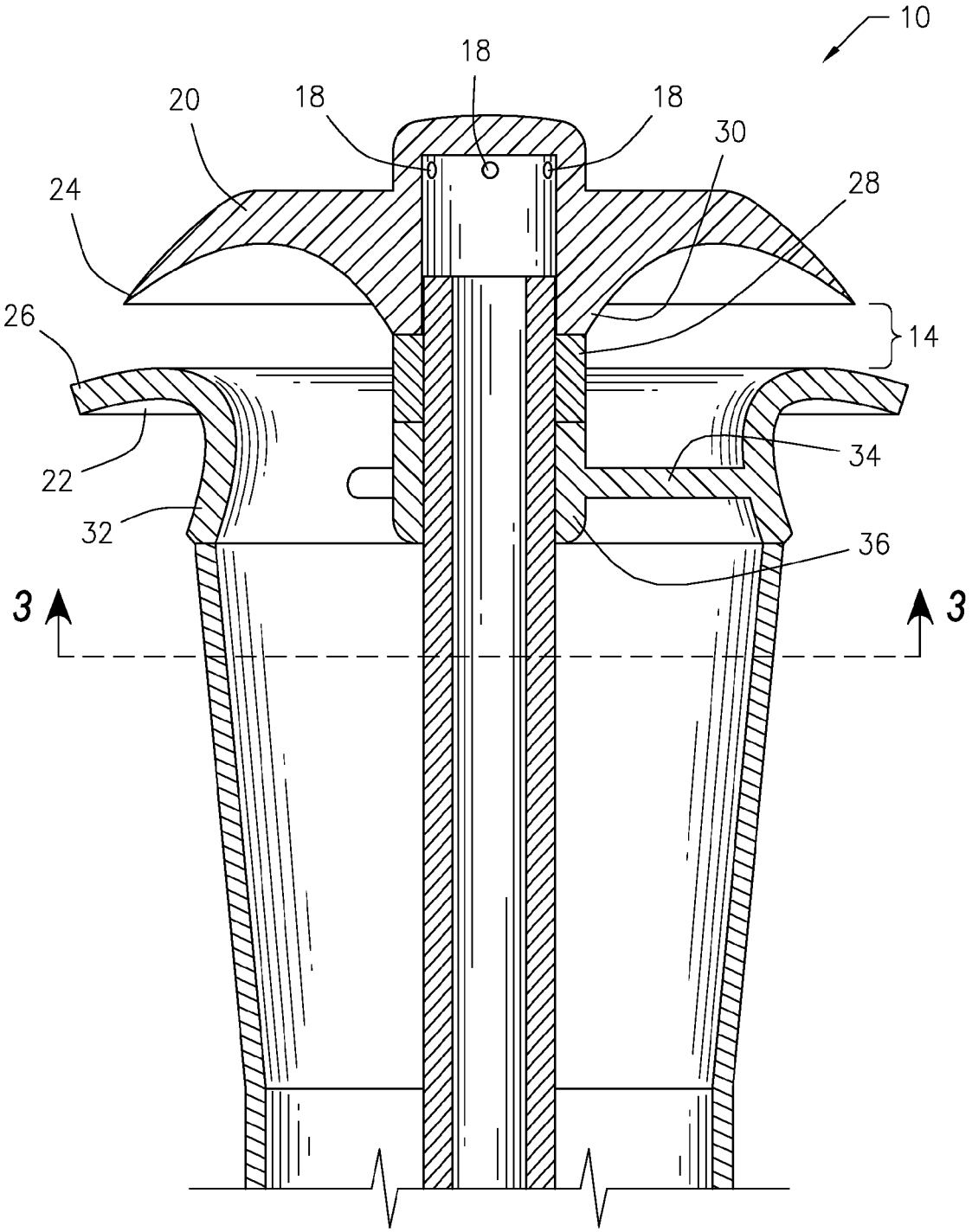
FIG. 2 illustrates a cross sectional view of the burner tip shown in FIG. 1.

FIG. 2 illustrates a cross-sectional view of an example of a radiant wall burner tip 10 constructed in accordance with an illustrative embodiment of the invention.

The shell created by the upper leaf 20 is illustrated. The knife-like edge 24 discourages flame attachment thereby reducing the leafs exposure to heat. Regardless of adjustment setting, the internal concave shape of the upper leaf 20 provides for a reduced flow area of the exit gap 14, thereby providing an increased exit velocity. The upper leaf 20 has an inner circumference that extends downwardly creating a cylindrical orifice cavity 30.

The lower leaf 22 has an outer circumference that extends radially downward beyond the upper leaf creating a curved lip 26. The curved lip design allows for streamline acceleration and prevents low velocity at the exit gap 14. The size of the exit gap 14, i.e. the distance between the upper leaf 20 and the lower leaf 22, may be adjusted by an adjustor pipe 28 located along the wall of an orifice cavity 30. The adjustor pipe 28 is a pipe cut precisely for the distance desired for the exit gap 14. The adjustor pipe 28 is in a cool zone of the burner tip, thereby reducing its exposure to heat and damage to the adjustor pipe 28. The lower leaf 22 has an inner circumference that creates a neck 32 and mounts onto the mixing conduit. The lower leaf 22 may have internal webbing pins 34 used for support. The internal webbing pins may connect the neck 32 of the lower leaf to a central ring 36. The webbing pins 34 are established horizontally at a distance away from the exit gap 14. The webbing pins 34 provide stabilization of the leaves of the burner tip 10, yet are positioned far enough away from the exit gap 14 that flow can recover from any disruption that is caused by the pins 34.

Figure 3:
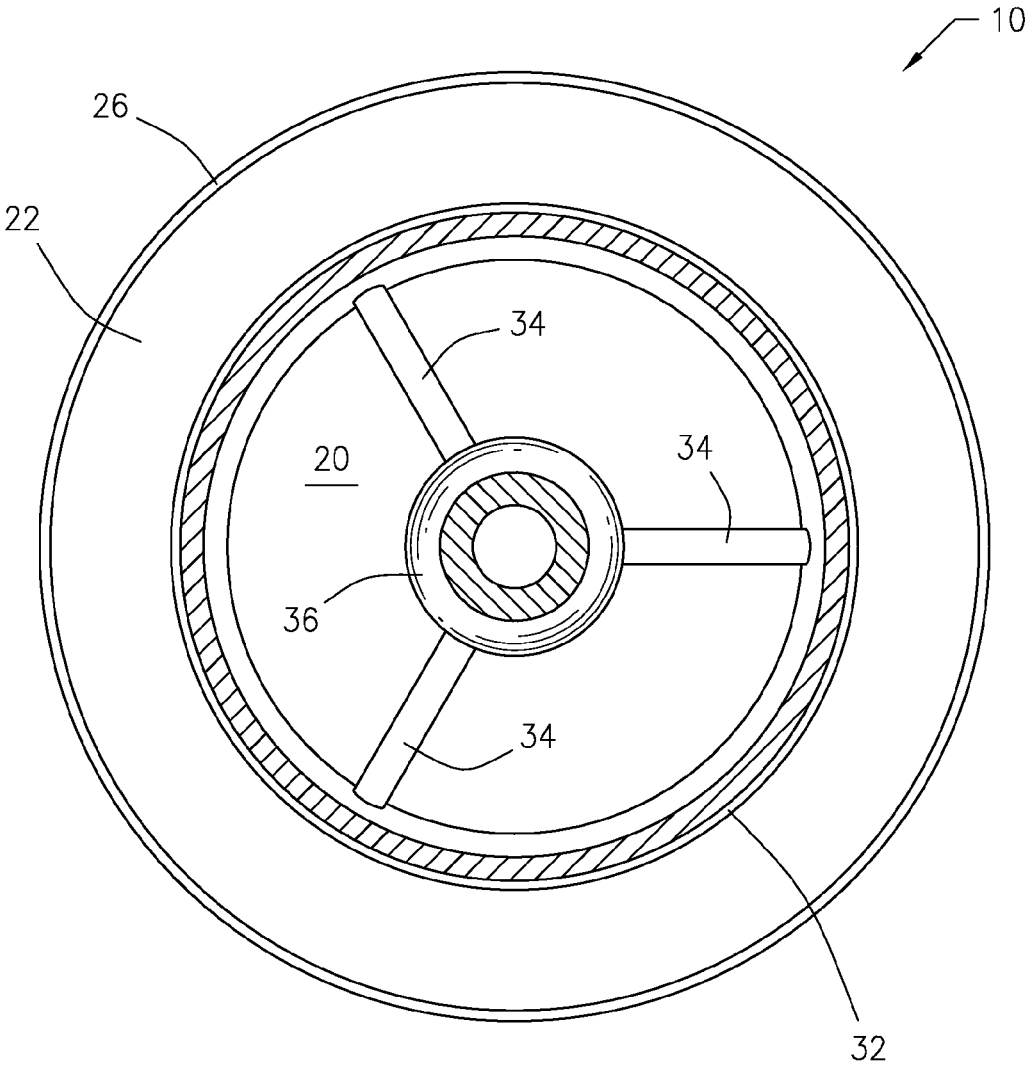
FIG. 3 illustrates a bottom view of the burner tip shown in FIG. 1.

FIG. 3 illustrates a bottom view of the example of a radiant wall burner tip constructed in accordance with the invention. Internal webbing pins 34 may connect the inside of the neck 32 of the lower leaf to a central ring 36. The central ring 36 will align with the adjustor pipe, and both will provide an opening for an orifice to extend through.

Accordingly, the aerodynamic design allows for an adjustable burner tip having a high flow efficiency. The improved design reduces the potential of flashback, heat deformation and manufacturing issues. With a reduced potential for flashback, the burner tip has a greater capability than previous designs to use high hydrogen as a fuel source.

Whereas, the devices and methods have been described in relation to the drawings and claims, it should be understood that other and further modifications, apart from those shown or suggested herein, may be made within the scope of this invention.

| | |
|---|---|
| Burner tip | 10 |
| Exit gap | 14 |
| Orifice | 16 |
| Secondary fuel Ports | 18 |
| Upper leaf | 20 |
| Lower leaf | 22 |
| Edge of upper leaf | 24 |
| Curved lip of lower leaf | 26 |
| Adjustor pipe | 28 |
| Orifice cavity | 30 |
| Neck of lower leaf | 32 |
| Webbing pins | 34 |
| Central Ring | 36 |

What is claimed is:

1. A radiant wall burner tip for a radiant wall burner having an elongated mixing conduit and an orifice passing there through, which tip comprises:

a concave, discoidal upper leaf with an outer circumference extending radially downward and an inner circumference creating a cavity;

a discoidal lower leaf with an outer circumference extending downwardly creating a curved lip and an inner circumference extending downward creating an extension connecting to a mixing tube; and an adjustor pipe located in along a wall of said cavity, wherein said adjustor pipe is cut to desired size indicative of desired exit gap.

2. A radiant wall burner tip as set forth in claim 1 wherein said upper leaf and said lower leaf are separate elements.

3. A radiant wall burner tip as set forth in claim 1 wherein said exit gap may be increased or decreased by way of an adjustment pipe between said upper leaf and said lower leaf.

4. A radiant wall burner tip as set forth in claim 1 wherein said outer circumference of said upper leaf may have a sharp, knife-like edge.

5. A radiant wall burner tip as set forth in claim 1 wherein said outer circumference of said lower leaf extends outwardly beyond said upper leaf.

6. A radiant wall burner apparatus as set forth in claim 1 wherein webbing pins may be used to connect said lower leaf to a central ring.

7. A radiant wall burner apparatus as set forth in claim 1 wherein said burner tip may be composed of a thick metal.

* * * * *